US007533512B2

(12) United States Patent
Levati et al.

(10) Patent No.: US 7,533,512 B2
(45) Date of Patent: May 19, 2009

(54) APPARATUS AND PROCESS FOR ASEPTICALLY PACKAGING FOOD PRODUCTS IN PRESEALED POUCHES

(75) Inventors: Manuele Levati, Parma (IT); Gianluca Oddi, Parma (IT); Gianluca Parisini, Parma (IT); Giovanni Rossi, Parma (IT)

(73) Assignee: FMC Technologies Italia S.p.A., Parma PR (IT)

( * ) Notice: Subject to any disclaimer, the term of this patent is extended or adjusted under 35 U.S.C. 154(b) by 6 days.

(21) Appl. No.: 11/855,671

(22) Filed: Sep. 14, 2007

(65) Prior Publication Data

US 2008/0072542 A1 Mar. 27, 2008

(30) Foreign Application Priority Data

Sep. 27, 2006 (EP) ..... 06425663

(51) Int. Cl.
*B65B 55/04* (2006.01)
*B65B 43/30* (2006.01)

(52) U.S. Cl. ..... 53/167; 53/426; 53/381.2; 53/386.1

(58) Field of Classification Search ..... 53/167, 53/284.7, 381.2, 386.1, 425, 426, 468, 469
See application file for complete search history.

(56) References Cited

U.S. PATENT DOCUMENTS

| | | | | | |
|---|---|---|---|---|---|
| 2,757,894 | A | * | 8/1956 | Kindseth | 53/167 |
| 2,773,285 | A | * | 12/1956 | Piazze et al. | 53/426 |
| 3,069,734 | A | * | 12/1962 | Leuthner | 53/425 |
| 3,149,649 | A | * | 9/1964 | Hix | 53/167 |
| 3,566,575 | A | * | 3/1971 | Lisiecki | 53/426 |
| 3,830,681 | A | * | 8/1974 | Wilson | 53/425 |
| 3,851,444 | A | * | 12/1974 | Merat | 53/167 |
| 4,014,153 | A | | 3/1977 | Wilson | |
| 4,021,283 | A | * | 5/1977 | Weikert | 53/426 |
| 4,452,030 | A | * | 6/1984 | Inada | 53/426 |
| 4,581,874 | A | | 4/1986 | Rechtsteiner et al. | |
| 4,656,813 | A | * | 4/1987 | Baldini et al. | 53/426 |
| 5,115,626 | A | | 5/1992 | Rutter et al. | |
| 5,569,438 | A | * | 10/1996 | Hilmersson | 53/425 |
| 6,058,678 | A | | 5/2000 | Lees | |
| 6,330,780 | B1 | * | 12/2001 | Shipway | 53/426 |

FOREIGN PATENT DOCUMENTS

| | | |
|---|---|---|
| DE | 2 243 074 | 3/1974 |
| JP | 01308726 | 12/1989 |
| JP | 07010111 | 1/1995 |
| JP | 2001002029 | 1/2001 |
| WO | WO 2004/011335 | 2/2004 |

* cited by examiner

*Primary Examiner*—Louis K Huynh

(57) ABSTRACT

An apparatus for aseptically packaging of a food product in presealed and internally presterilized pouches. The apparatus comprises a filling chamber (2*b*) positioned above a sterilization pre-chamber (2*a*) of the pouches (S). At an opening (9) between the filling chamber (2*b*) and the sterilization pre-chamber (2*a*) there is arranged a widening device (17) of the pouches (S) which is suitable for holding a pouch (S) in a working position for the filling wherein only a filling end of the pouch is located in the filling chamber (2*b*).

10 Claims, 9 Drawing Sheets

4
5
7
6
5
3
7
8
14
2
10
26
9
5
20
13

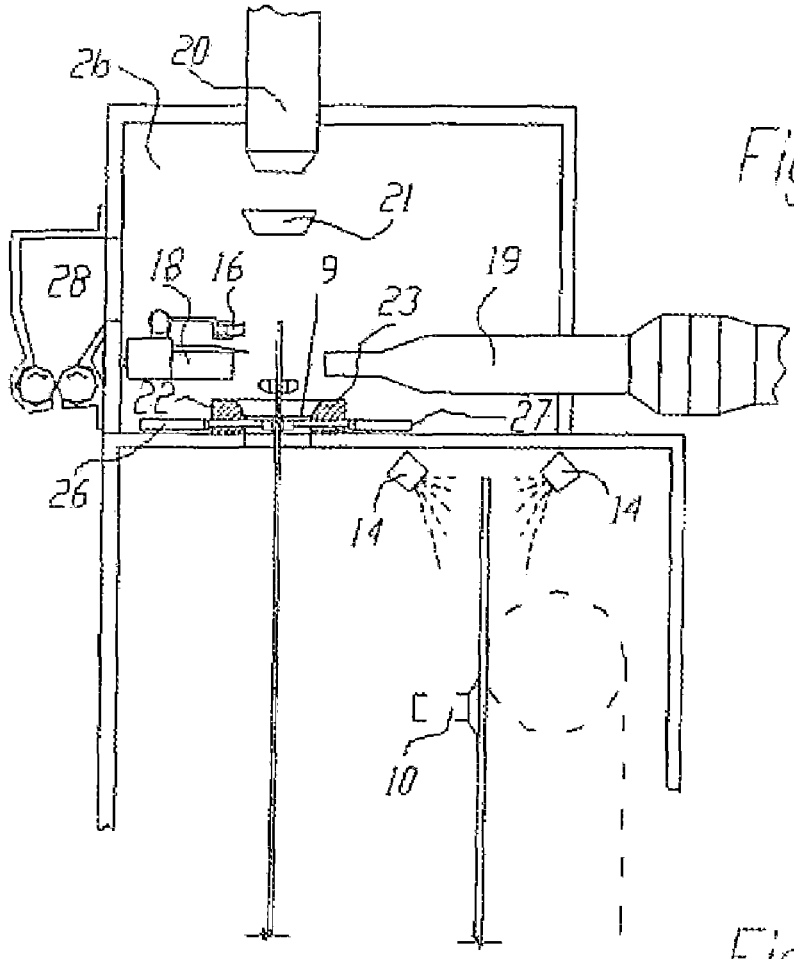
Fig. 3b
Fig. 4b
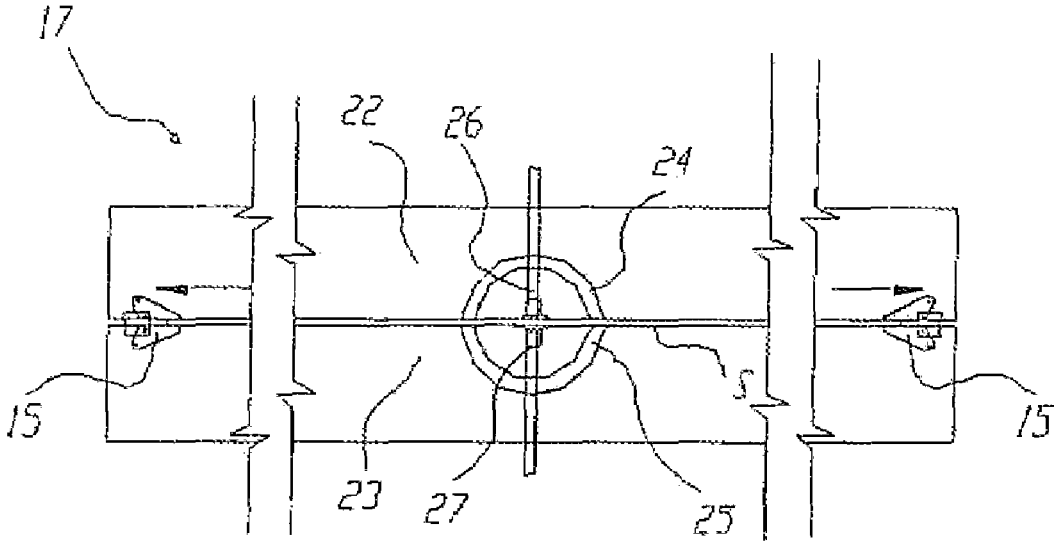

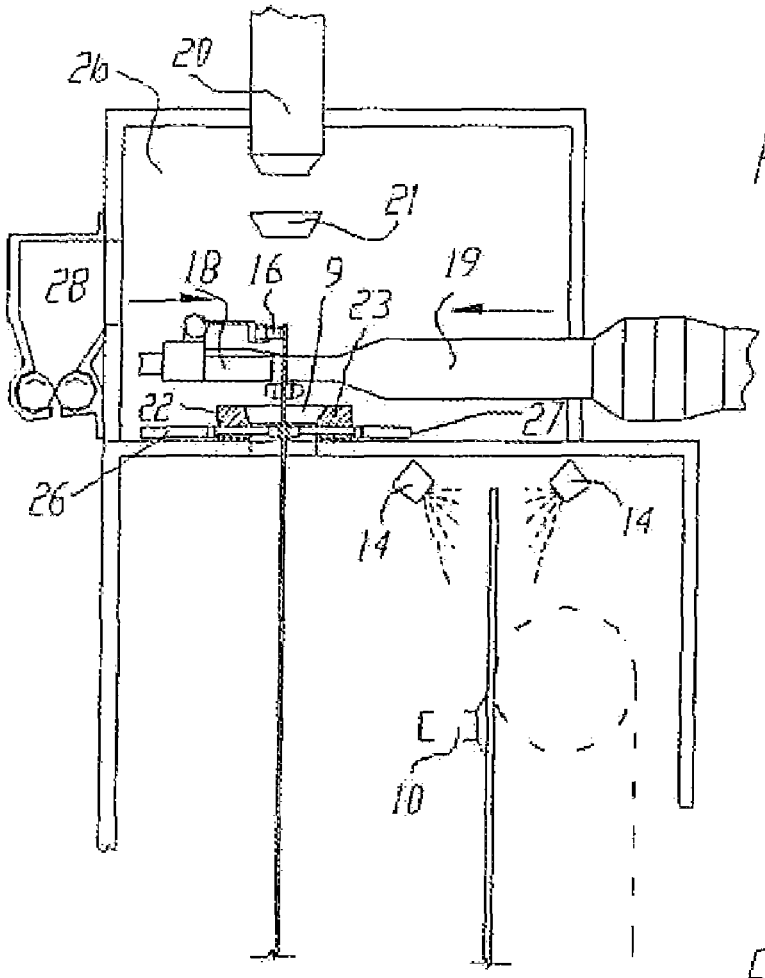
Fig. 3c
Fig. 4c
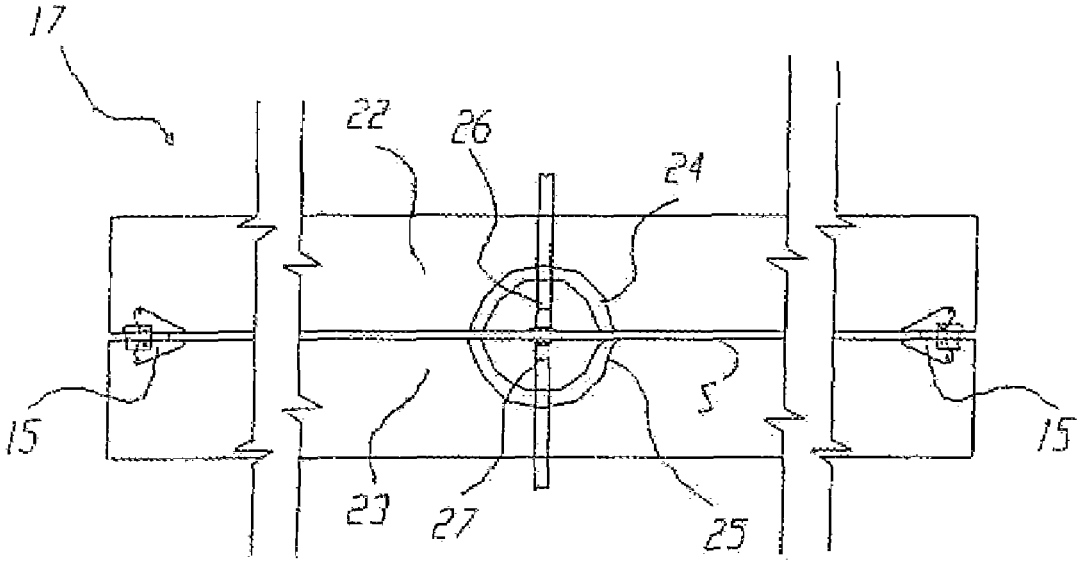

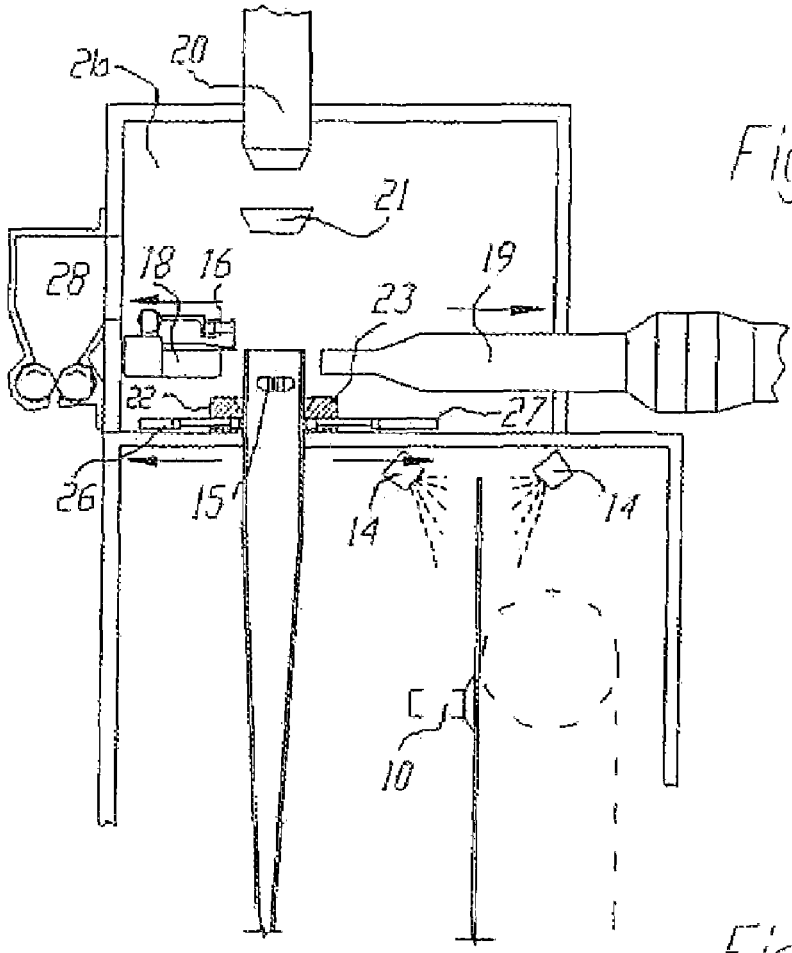
Fig. 3d
Fig. 4d
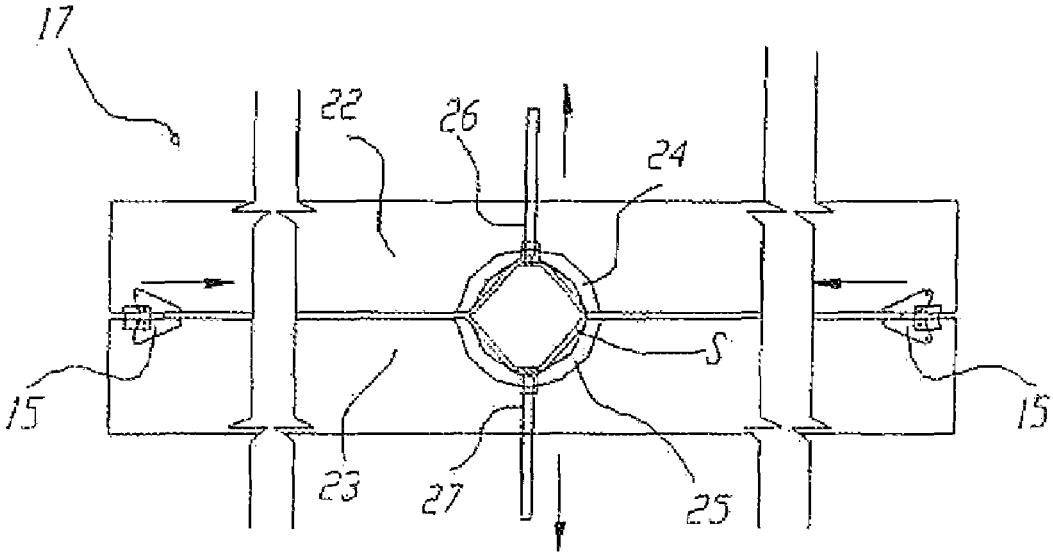

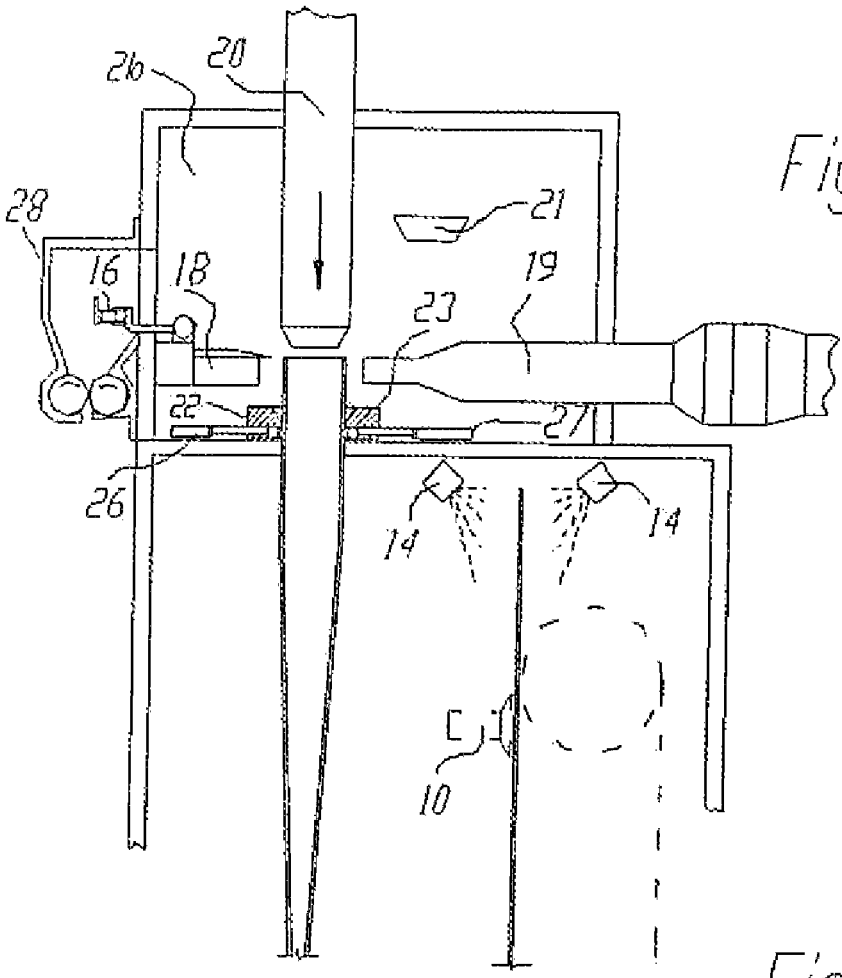
Fig. 3e
Fig. 4e
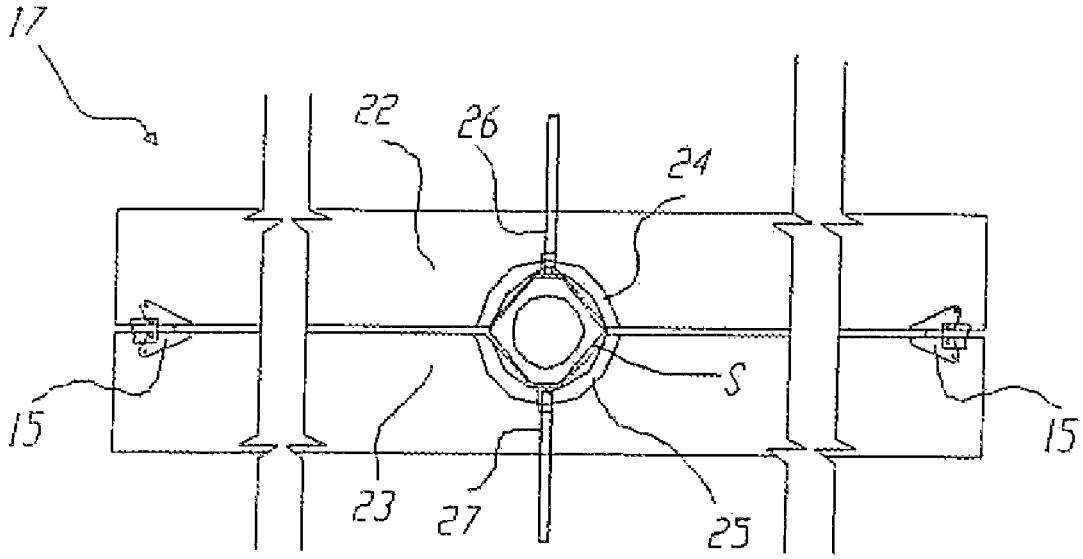

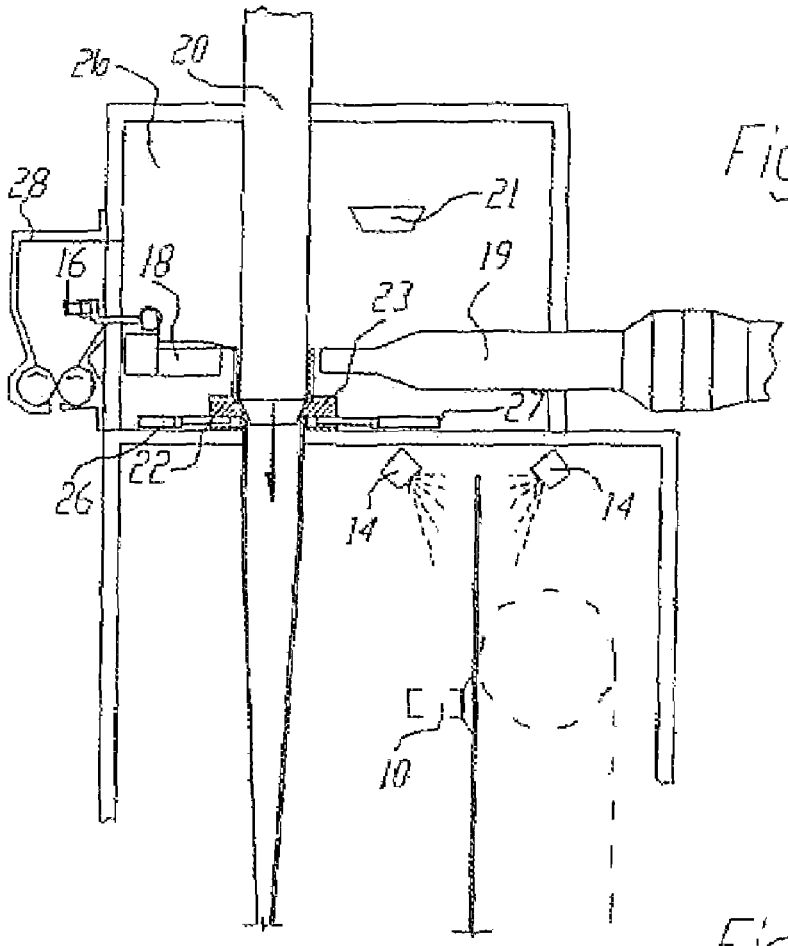
Fig. 3f
Fig. 4f
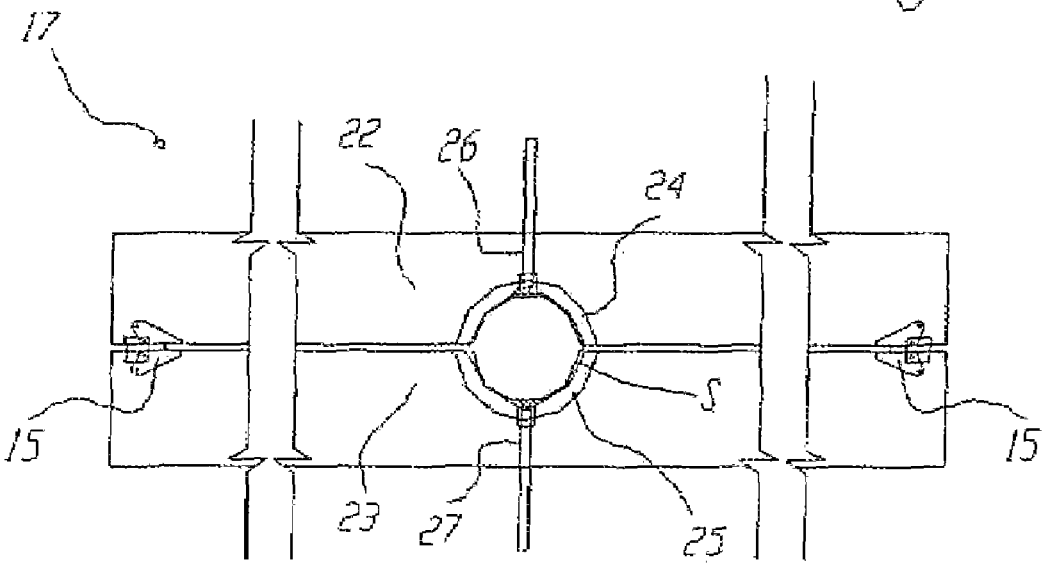

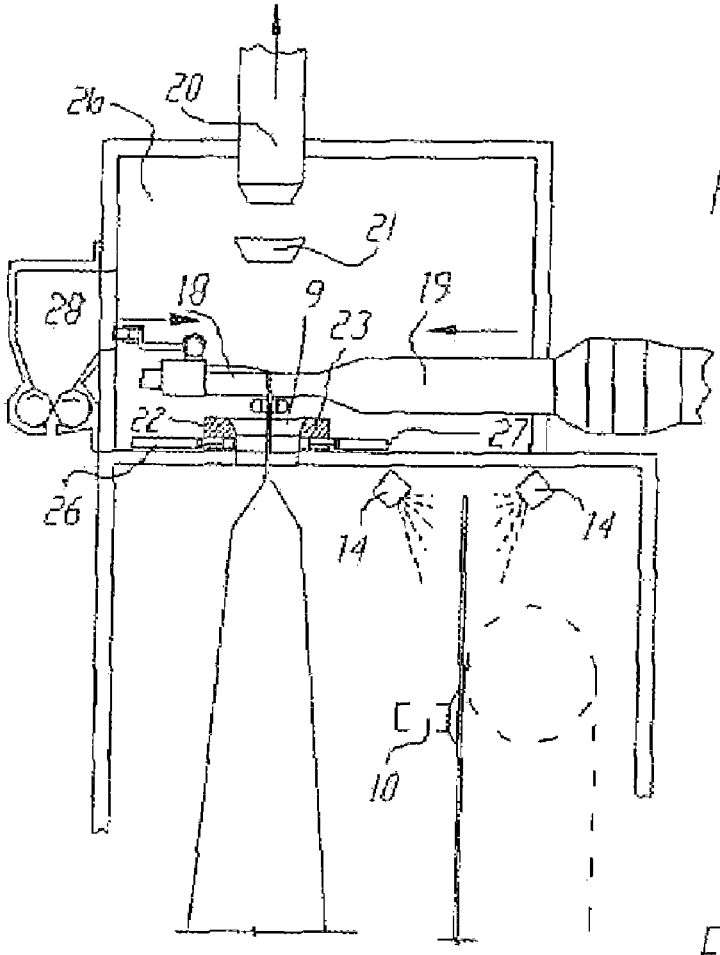
Fig. 3g
Fig. 4g
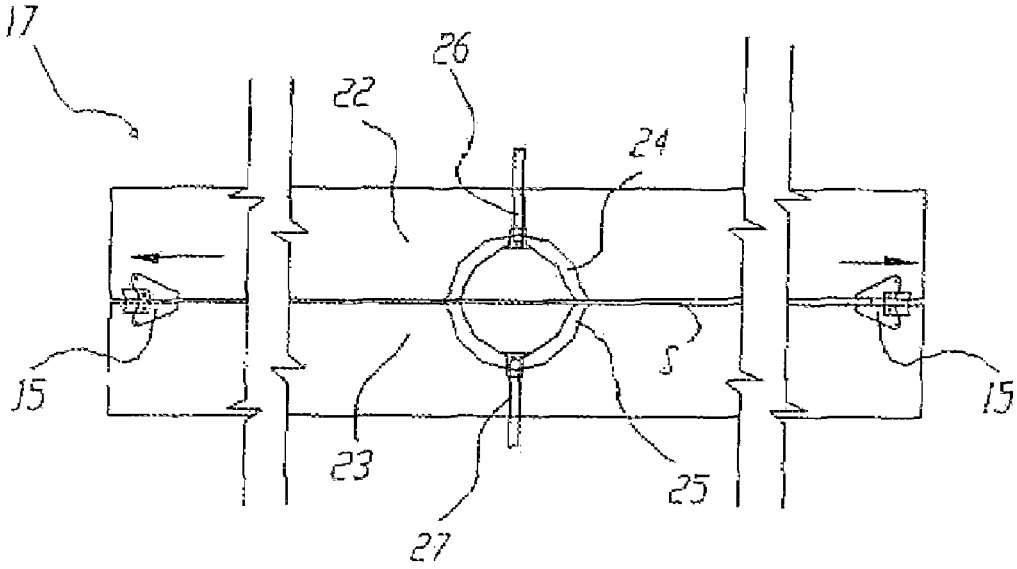

APPARATUS AND PROCESS FOR ASEPTICALLY PACKAGING FOOD PRODUCTS IN PRESEALED POUCHES

This patent application claims the benefit of priority from European Patent Application No. 06425663.9 filed Sep. 27, 2006 the contents of which are incorporated herein by reference.

FIELD OF THE INVENTION

The present invention relates to an apparatus and a process for aseptically packaging food products having high degradability, such as tomato juice or fruit or vegetable purees, in presealed pouches.

BACKGROUNG OF THE INVENTION

It is known that many of the aseptic apparatuses for packaging fluid food products make use of aseptic pouches provided with a sealable spout, through which the pouch is opened, filled in with the food product and then closed again in sterile environment. Said spout has merely the function of making easier the packaging of the food product, but is not used for emptying the pouch by the final user who generally carries out this operation by cutting the pouch so as to remove the whole upper edge thereof.

There are also some known apparatuses which are specific for spoutless pouches, which allow a considerable economic saving, thanks to the fact that the cost of the spout is notably relevant With respect to the entire cost of the pouch, particularly for the small pouches, which are also the most common.

An apparatus of this kind is disclosed in JP01308726. Said apparatus comprises a sterilization pre-chamber, wherein spray disinfection of a band comprising a multiplicity of pouches connected in series and separation of single pouches from the band are carried out, and a filling chamber positioned at the side of said pre-chamber, wherein the pouches are guided, by means of a rotating table mechanism, to several stations for opening, filling, sealing and finally expelling the filled pouches.

Also JP2001002029 describes an apparatus comprising two chambers positioned side by side, the first chamber being intended for spray disinfection and opening of the pouches, and the second for their filling and sealing. Also in this case, the transport of the pouches inside said second chamber is carried out thanks to a rotating table mechanism.

JP07010111 describes an apparatus of the type described above, yet comprising three chambers. In the first chamber, sterilization of the pouches with hydrogen peroxide and subsequent drying are carried out, in the second the pouches are opened, whereas in the third chamber the pouches are, widened, filled and sealed. In this apparatus too, a rotating table mechanism guides the pouches to the widening, filling and sealing stations of the pouches.

A drawback of these known apparatuses consists in that they comprise an extremely large aseptic zone, inside which the control of the actual aseptic conditions is difficult and expensive. As a matter of fact, said zone comprises at least two distinct aseptic chambers, of which at least one has a particularly large size, since it must contain a rotating table mechanism which allows processing of the pouches.

On the other side, separation of the sterilization chamber from the filling and sealing chamber is necessary in order to prevent a contamination of the food product by means of the disinfecting product. As a matter of fact, the risk of such a contamination would occur if in a single chamber the filling of a pouch were carried out at the same time with the disinfection by spraying of another pouch.

Moreover, the apparatuses of the described type are very complex and require large areas for their installation.

WO2004/011335 describes an apparatus generically proposed for the packaging of food or pharmaceutical products, wherein the pouches for the product are opened, filled and closed inside a single protected environment, inside which a certain degree of vacuum is maintained, in order to avoid that the high quantity of oxygen present in the air deteriorate the product. Said patent application also mentions the possibility of carrying out a sterilization of the pouches, but it neither explains what disinfecting means can be used, nor how the contamination of a food product by means of the sterilizing agent can be avoided.

Therefore, said apparatus has the drawback that it can be possibly used only for packaging food products having low degradability, for which maintaining a rare atmosphere inside the filling chamber is a sufficient measure in order to guarantee a correct preservation, or together with sterilizing stations such as autoclaves. The apparatus however is not suitable for packaging highly deteriorable foods, such as juices and purees of fruit and vegetables, for which said measure is not sufficient since they require an accurate disinfection of the pouches and of the filling environment.

There are also known packaging apparatuses comprising a single aseptic chamber, inside which suitably sterilized pouches are opened, filled in with a food product and sealed. In such known apparatuses the sterilization of the pouches is obtained by immersion in a bath of a disinfecting liquid.

For example, U.S. Pat. No. 4,581,874 describes a packaging apparatus wherein a disinfecting bath is arranged at the bottom of the aseptic chamber, so that the upper surface of said bath forms the lower border of the chamber. Therefore, the disinfecting bath also has the function of isolating the inside of the aseptic chamber from the external environment.

However, the presence of the bath implicates various ties for the apparatus structure. For example, transporting the pouches implies the need of a complex device with swing mobile arm which allows gripping them from an entrance station arranged above the bath surface, dipping them into the bath for a period of time sufficient in order to carry out their disinfection, and carrying them into the aseptic chamber, then making the opposite path in order to eject the filled and sealed pouches. In order to ensure an acceptable process speed, the apparatus comprises two identical transporting devices, which work with an alternate rhythm on the two apparatus sides.

Besides having a particularly complex structure, the apparatus is also very bulky due both to the fact that the two transporting devices of the pouches are voluminous and require a lot of space for the swinging of the mobile arms, and to the need to contain also the above mentioned disinfecting bath inside it.

Moreover, in general the disinfection by means of disinfecting baths is scarcely advantageous since it is less effective, and requires the use of large volumes of sanitizer which involve, in addition to a high cost, also a significant risk of toxicity particularly for the workers of the apparatus.

Another packaging apparatus wherein the sterilization of the pouches is carried out by dipping in a disinfecting liquid is disclosed in U.S. Pat. No. 5,115,626. This apparatus is very bulky and complex too, and it even comprises two disinfecting baths as well as two toothed belt transporting systems for the pouches.

SUMMARY OF THE INVENTION

Therefore object of the present invention is to provide an apparatus and a process for aseptically packaging food products, which overcomes the above-mentioned drawbacks.

Said object is reached by means of an apparatus whose main features are specified in the first claim . Other advantageous features of the apparatus and the process according to the present invention are specified in the depending claims.

A first primary advantage of the apparatus according to the present invention consists in that it has extremely reduced size.

The pouches for the food product, which are intern ally presterilized and presealed, enter the apparatus according to the invention when they are still closed, and inside said apparatus they are externally sterilized, opened, filled in and sealed, so that the guarantee regarding the sterility of the whole filling process is absolute.

Another advantage of the apparatus and of the process according to the invention consists in that they provide for the disinfection of the pouches by means of distributing devices by spraying or atomizing, which is more efficient and less expensive than that obtained by disinfecting baths. The disinfection of a pouch can be made while at the same time filling of another pouch is being carried out, thus ensuring a high velocity of the filling process but excluding at the same time the contamination of the food product by means of the disinfecting agent.

Still another advantage of the apparatus according to a preferred embodiment of the present invention consists in that the widening of the pouch end, through which filling is carried out, is limited to a minimum zone, thus preventing backing ups of the food product already injected into the pouch which could occur with the apparatuses according to the state of the art. Said minimum widening has the effect of further reducing the possibilities of contamination of the food product by means of the disinfecting agent.

According to a preferred embodiment of the process according to the invention, the pouches can be opened, filled and closed without producing any waste.

These and other advantages and features of the apparatus and process according to the present invention will appear to those which are skilled in the art from the following detailed description of an embodiment thereof, with reference to die accompanying drawings wherein:

DETAILED DESCRIPTION OF THE DRAWINGS

Figure 1:
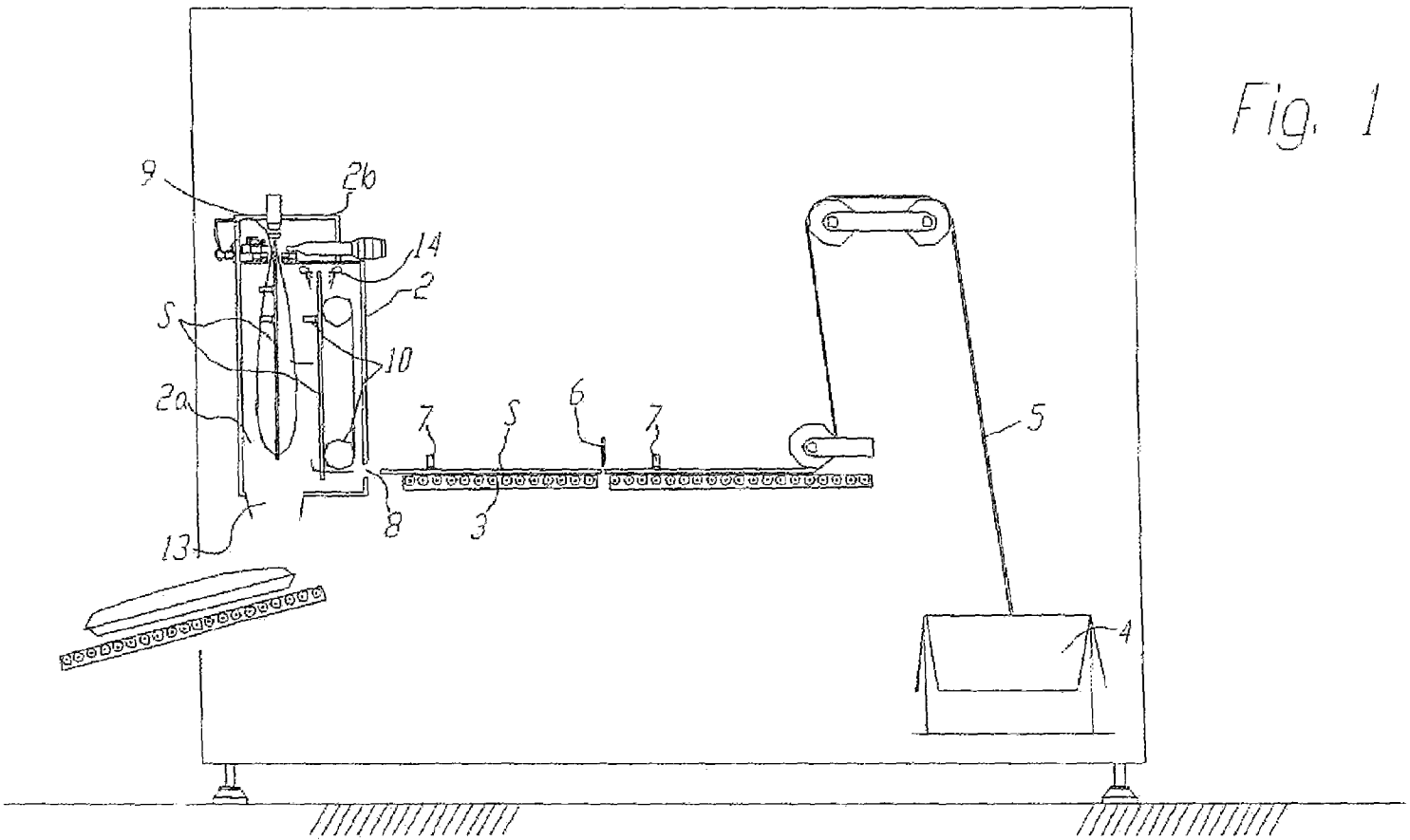
FIG. 1 is a schematic side view in cross-section of the apparatus according to a first embodiment of the invention.

As shown in FIG. 1, the apparatus 1 for aseptically packaging food products in presealed pouches comprises a chamber 2 inside which all the steps relating to opening, filling and closing the pouches are carried out.

A conveyor 3, preferably formed of a roller conveyor or a belt conveyor, is arranged externally to said chamber 2 and is suitable for taking presealed pouches S from a container 4. Said pouches are preferably in the form of a continuous band 5, and are brought to a separating device 6 which has the function of dividing single pouches S from band 5.

The presealed pouches are previously internally sterilized by means of any process known in the art, for example by means of γ-rays.

The single pouches S separated by separating device 6 are then seized by suitable carrying means 7, which bring the pouches at an entrance 8 of chamber 2.

For example, carrying means 7 can be formed of a small carriage sliding on a track and advantageously comprise one or more suction cups, pliers or other means for gripping the pouches. Said means 7 also have the function of stopping up the band at the separating device 6, so as to prevent the apparatus from blocking due to undesired movements of the band 5 at the moment of the separation of the single pouches S.

Figure 2:
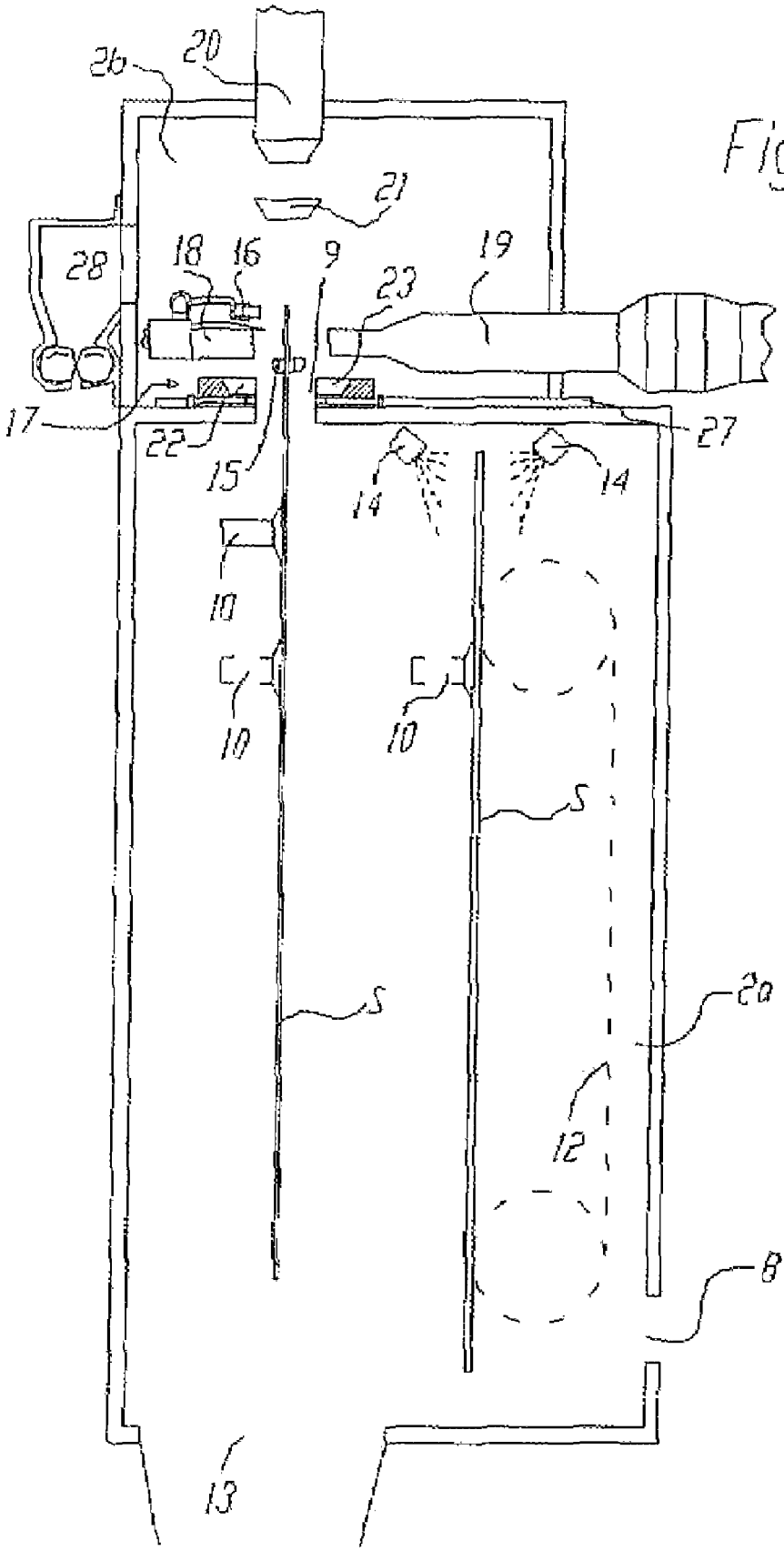
FIG. 2 is a schematic view in cross-section of the chamber of the apparatus according to the embodiment of FIG. 1.

As shown in FIG. 2, chamber 2 is divided in a sterilization pre-chamber 2*a* and a filling chamber 2*b*, separated by means of a wall. Said filling chamber 2*b* is arranged above said sterilization pre-chamber 2*a* and the entrance 8 of said chamber 2 is made in the sterilizing pre-chamber 2*a*.

The wall separating said filling chamber 2*b* and said sterilization pre-chamber 2*a* is provided with an opening 9, having elongated shape, for the insertion of a filling end of a pouch S into said filling chamber 2*b*.

As shown in the drawing, the filling chamber 2*b* has the smallest possible size since it is intended for housing only said filling end of the pouches S, i.e. the end through which filling with the food product is carried out.

In the sterilization pre-chamber 2*a* are provided transport means 10 suitable for seizing a pouch S positioned at the entrance 8, which at that position is released by carrying means 7, and for conveying it into the sterilization pre-chamber 2*a*. Also said transport means 10 are suitably provided with suction cups or other means for gripping the pouch.

The entrance 8 may be provided with a door which automatically closes when there are no passing pouches, in order to maintain the inside of the chamber insulated from the outside.

Said transport means 10 which hold the pouch travel along a path which, thanks to the movement of means 10, allows to carry the pouches from said entrance 8 to a position next to said opening 9. For example, said path may be followed by means of a chain conveyor 12.

For example, the transport of the pouches along said path may extend essentially in a vertical direction, from an entrance 8 positioned in the lower part of pre-chamber 2*b* up to said opening 9.

Between said entrance 8 and said opening 9, the pouch S stops next to distributing devices 14 of a sanitizer, for example spray devices or atomizing devices. In this way, transport means 10 take the pouches S to said disinfecting devices 14 in order to disinfect the outside thereof before it undergoes the packaging operations of the desired food product. The sanitize, sprayed or atomized by means of said devices 14, may be any sanitizer known for this kind of application. For example, hydrogen Peroxide may be advantageously used, possibly additioned with peracetic acid and surfactants, or other likewise efficient sterilizing agents, which used in small quantities like in the spraying or atomizing devices does not imply toxicity problems nor other risks for the workers of the apparatus.

Hot sterile air is circulated in the sterilization pre-chamber 2*a* in order to dry the disinfected pouch.

In the filling chamber 2*a*, next to said opening 9, there are also provided gripping means 15 suitable for gripping the pouch S, which in this position is released from transport means 10. Said gripping means 15 preferably comprise a support, whereon two pliers members intended for gripping and holding the pouch at two sides thereof are provided. Said pliers members have a controllable mutual distance and therefore are suitable for adjusting the tension of the filling end of pouch S.

Once inserted into the filling chamber 2*b*, the upper edge of the filling end of the pouch is engaged by a device 16 which, according to an embodiment of the invention, removes said edge after that it has been cut from pouch S.

Between the sterilization pre-chamber 2*a* and the filling chamber 2*b*, next to said opening 9 there is arranged a pouch widening device 17, which is suitable for widening a pouch S situated in a working position for filling, in which position only a filling end of the pouch is contained in the filling chamber, whereas a lower portion thereof stretches in the sterilization pre-chamber 2*a*.

The widening device 17 is mobile and is shown in FIG. 2 in a configuration wherein it leaves free opening 9, thus allowing the filling end of a pouch S to pass through said opening. Yet in another configuration thereof, as it will be shown in the next figures, said widening device 17 holds pouch S widened and it cooperates therewith for substantially obstructing said opening 9.

Above said widening device 17, a cutting device 18 for cutting the pouch and a scaling device 19 for sealing the pouch, for example by heating or by ultrasound, are arranged in filling chamber 2*b*. A filling mouth 20, through which the product to be packaged is filled into the pouch, is also provided in filling chamber 2*b*. A drop collector 21 prevents that the food product remaining on the filling mouth 20 may drip, thus dirtying the inside of chamber 2*b*.

Figure 3A:
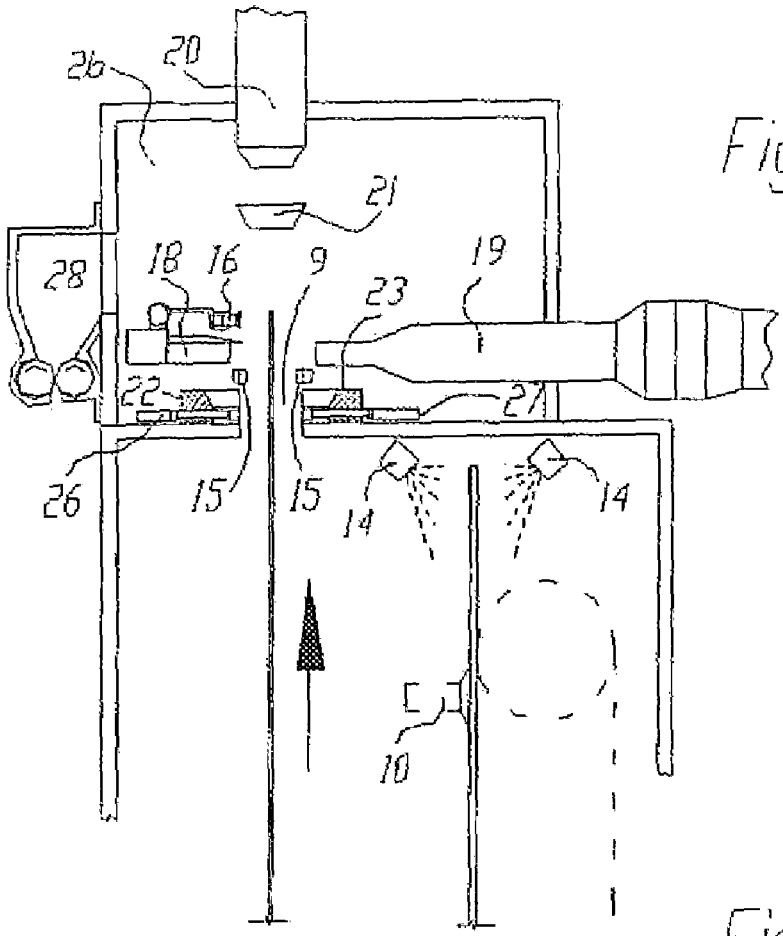
FIGS. 3(*a-g*) are schematic views in cross-section of a filling chamber in the various steps of the filling process.
Figure 4A:
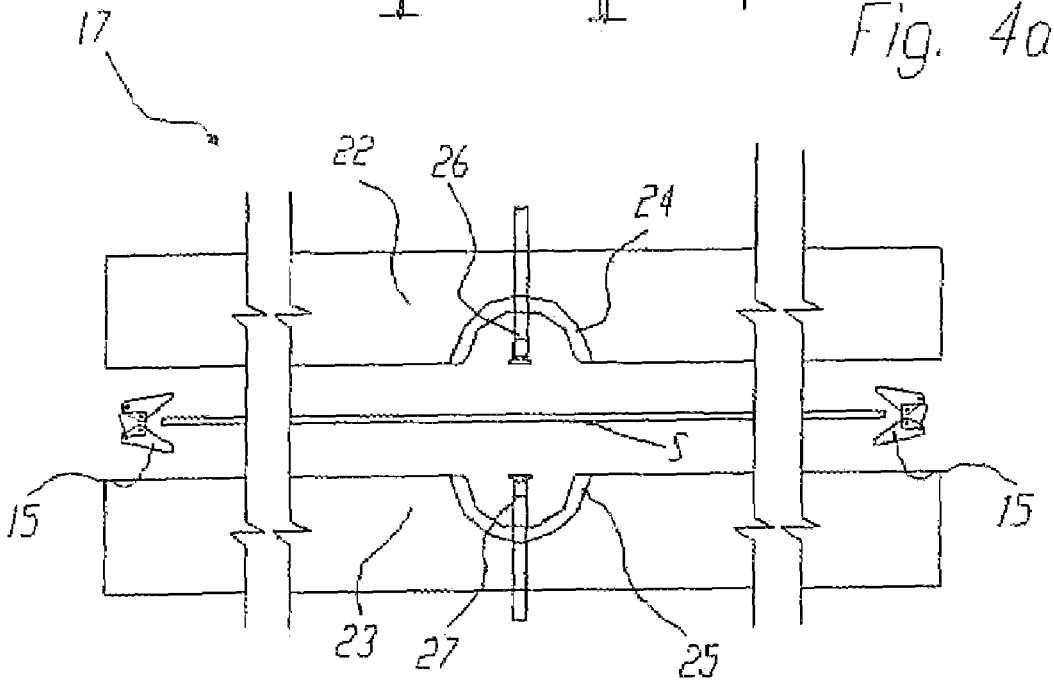
FIGS. 4(*a-g*) are schematic partial top views of a widening device of the pouch in the various steps of the filling process corresponding to those of FIG. 3.

With reference to FIGS. 3*a* and 4*a*, there is shown that widening device 17 comprises two clamping members of the pouch S positioned at two sides of opening 9. In a preferred embodiment of the invention said clamping members are formed of plates 22, 23, parallel to each other. On the side turned towards said opening 9, each plate is provided with a semicircular recess.

According to the process of the invention, in a first configuration of said widening device, plates 22, 23 are spaced apart from each other in order to allow insertion of a filling end of a pouch S, from sterilization pre-chamber 2*a* into filling chamber 2*b*, through opening 9.

Then, as shown in FIG. 3*b* and FIG. 4*b*, plates 22, 23 are brought close to each other so as to hold pouch S by clamping it between them. At this moment, the only passage between said chamber and said pre-chamber is the circular hole obtained by placing the two semicircular recesses 24, 25 of plates 22, 23 close together. Said circular hole forms a seat for the insertion of filling mouth 20.

In this working position of the pouch, in which the filling is carried out, only one filling end of the pouch S is situated in the filling chamber 2*b*.

Each of plates 22, 23 is provided with a pouch widening member, which is arranged at the center of the semicircular recess 24, 25 and is retractile in a suitable housing inside the corresponding plate. Said widening members 26 and 27 are preferably formed of two small rods perpendicularly arranged with respect to plates 22 and 23. Each rod bears a suction cup mounted at the free end thereof.

In the configuration shown in FIGS. 3*b* and 4*b*, the widening members 26, 27 protrude from the corresponding plates and get hold of the external surface of a pouch S, which is still closed.

In FIG. 3*c* there is shown that the pouch is then cut by means of the cutting device 18, which, according to one embodiment of the invention, cuts the upper edge of the pouch by advantageously using said sealing device 19 as cutting counterpart. In order to carry out said operation, the cutting and sealing devices are brought close to each other, while the configuration of widening device 17 does not change, as shown in FIG. 4*c*. The removed upper edge of the pouch, which forms a waste, is supported by removal device 16.

On the contrary, in a preferred embodiment of the invention, the pouches used are those forming the subject matter of copending application Nr. 06425457.6 in the name of the same applicant, for which it is advantageous to make only a partial cutting of the pouch in a determined zone of the filling end, without removing an edge thereof. In this case, the removing device 16 may be replaced by a similar device being though intended for holding two side edges of the pouch filling end well apart, so that they do not hinder the insertion of the filling head 20 into the pouch.

As shown in FIGS. 3*d* and 4*d*, as soon as the pouch is cut, the widening members 26, 27 are retracted into the corresponding plates 22, 23 which do not move. In this way, the filling end of the pouch S is advantageously widened only partially, that means of the minimum necessary amount in order to allow the subsequent insertion of the filling mouth 20 thereinto. At the same time, in order to permit widening of the pouch within the semicircular recesses 24, 25, gripping means 15 release part of the tension at the end of the pouch, by getting reciprocally closer. Besides, devices 18, 19 move away from each other so as to allow filling mouth 20 to approach the widened pouch.

The circular hole, resulting from the two semicircular recesses being placed close together, which formed the only passage between said filling chamber and said sterilization pre-chamber when the pouch was closed, is at this moment substantially obstructed by means of the widened pouch and consequently the internal surface of each pouch S does not come into contact with the atmosphere present in the sterilization pre-chamber 2*a*, but only with that of the filling chamber 2*b*.

In other words, in this configuration said widening device 17 cooperates with a pouch S which is being filled for substantially obstructing said opening 9, thus separating said pre-chamber 2*a* from said filling chamber 2*b*.

Also waste removing device 16, is provided, moves away to one side and, as shown in FIG. 3*e*, ejects said waste through a suitable ejecting device 28. For example, said device may comprise two counter-rotating rollers suitable for guiding the elimination of the waste from the apparatus. The ejecting device 28 can be missing if the pouches which are subject matter of the copending application Nr. 06425457.6 are used in the apparatus. In FIG. 4*e* the profile of the approaching filling mouth 20 can be seen.

Then, as shown in FIG. 3*f*, filling mouth 20 is brought inside the filling end which assume the circular shape shown in FIG. 4*f*. The food product to be packaged is injected into the pouch. Optionally, before each packaging, steam or other sterilizing means can be used inside filling chamber 2*b* in order to disinfect the environment.

After that, the pouch is closed by means of the sealing device 19, which preferably uses the frontal part of the cutting device 18 as a sealing counterpart, by sealing together the open side edges of the pouch. At the same time the tension of the filling end is adjusted thanks to gripping means 15, as shown in FIGS. 3*g* and 4*g*.

The filled pouch is now released by plates 22, 23 and by gripping device 15 and leaves the packaging apparatus, preferably by falling, by passing through an outlet 13 which is positioned immediately under said opening 9. Similarly to entrance 8, also said outlet can be provided with one or more doors, which remain closed when no pouches are passing and has the purpose of maintaining the inside of chamber 2 insulated from the outside.

Before being inserted into chamber 2, air is cleaned, for example by means of a bacteriologic filter. A slight air overpressure, is also maintained in chamber 2, in order to prevent contaminant substances to enter it, for example when the doors of the entrance 8 or of the outlet 9 are opened.

The efficiency of the aseptic apparatus 1 according to the present invention for packaging food products in presealed pouches is high, since the pouches being processed at the same time are at least two. In addition, besides ensuring a high working efficiency, the whole size of chamber 2, and consequently the size of the whole aseptic packaging apparatus 1 is minimum since it is just such as to contain the two pouches under processing.

The invention claimed is:

1. An apparatus (1) for aseptically packaging a food product in presealed, internally presterilized pouches (S), comprising a filling chamber (2*b*) and a sterilization pre-chamber (2*a*) of the pouches (S), devices for cuffing (18), filling (20) and sealing (19) the pouches (S) being arranged in said filling chamber (2*b*), a sanitizer distributing device (14) being arranged in said sterilization pre-chamber (2*a*), characterized in that said filling chamber (2*b*) is positioned above said sterilization pre-chamber (2*a*), said filling chamber (2*b*) and said sterilization pre-chamber (2*a*) being separated by means of a wall provided with an opening (9) at which a pouch widening device (17) is arranged, which is suitable for holding a pouch (S) in a working position for the filling wherein only a filling end of said pouch (S) is located in the filling chamber (2*b*).

2. An apparatus according to claim 1, characterized in that said widening device (17), in a first configuration thereof, allows the filling end of a pouch (S) to pass through said opening (9), whereas in a second configuration thereof holds the pouch (S) widened and cooperates therewith in order to substantially obstructing said opening (9).

3. An apparatus according to claim 1, characterized in that said widening device (17) comprises two plates (22,23) which are mobile parallely to each other and arranged at the sides of opening (9), each being provided, on the side facing said opening (9). of a semicircular recess (24, 25) which houses a widening member for the pouches (S).

4. An apparatus according to claim 3, characterized in that said widening members are formed of rods (26,27) which are retractile in a suitable housing inside the plates (22,23) and bear, at a free end thereof, a suction cup.

5. An apparatus according to claim 1, characterized in that in the filling chamber (2*b*), next to said opening (9), there are arranged gripping means (15) suitable for adjusting the tension of the filling end of the pouches (S).

6. An apparatus according to claim 5, characterized in that said gripping means (15) comprise a support on which two pliers members having an adjustable distance, intended for gripping the pouch at two sides thereof, are arranged.

7. An apparatus according to claim 1, characterized in that in said sterilization pre-chamber (2*a*) there are provided transport means (10) suitable for carrying the pouches from an entrance (8) of said pre-sterilization pre-chamber (2*a*) to a position next to said opening (9).

8. An apparatus according to claim 1, characterized in that said sanitizer distributing device (14) is a spraying or atomizing device.

9. An apparatus according to claim 1, characterized in that it comprises a separating device (6) positioned outside said filling chamber (2*b*) and sterilization pre-chamber (2*a*), suitable for separating single pouches (S) from a continuous band (5).

10. An apparatus according to claim 9, characterized in that it comprises a conveyor (3) suitable for taking said continuous band (5) to said separating device (6) and carrying means (7) suitable for taking single pouches (S) separated from said separating device (6) and to bring them to an entrance (8) of said sterilization pre-chamber (2*a*).

* * * * *